United States Patent [19]

Montgomery

[11] 3,971,487

[45] July 27, 1976

[54] THREADED CAP AND NECK FOR A LIQUID CONTAINER

[75] Inventor: Gary Van Montgomery, Evansville, Ind.

[73] Assignee: Sunbeam Plastics Corporation, Evansville, Ind.

[22] Filed: July 18, 1975

[21] Appl. No.: 596,979

[52] U.S. Cl. ..... 215/216; 215/217; 215/224

[51] Int. Cl.[2] ..... B65D 55/02; B65D 85/56; A61J 1/00

[58] Field of Search ..... 215/91, 216, 217, 223, 215/224, 225, 329, 330, 318, 342, 350

[56] References Cited

UNITED STATES PATENTS

| | | | |
|---|---|---|---|
| 3,679,084 | 7/1972 | Aronson | 215/224 |
| 3,894,647 | 7/1975 | Montgomery | 215/216 |
| 3,896,959 | 7/1975 | Roy | 215/350 X |

*Primary Examiner*—George T. Hall
*Attorney, Agent, or Firm*—Henry K. Leonard

[57] ABSTRACT

A combination threaded cap and neck finish for a liquid container having mating threads on the cap interior and the exterior of the neck and also having second cooperating cam means on the cap and the container neck for applying downward thrust to the cap to maintain liquid tight sealing of the container neck even when the cap is rotated in the loosening direction through an angle relative to the container neck so as to disengage the downward thrusting surfaces of the mating threads. One embodiment of the invention also has child-resistant cooperating means preventing removal of the cap unless such means are disengaged by a separate and different manipulation.

10 Claims, 10 Drawing Figures

THREADED CAP AND NECK FOR A LIQUID CONTAINER

BACKGROUND OF THE INVENTION

Many child-resistant caps and closures have been suggested in recent years because of the greater activity directed toward insuring that dangerous and poisonous materials be packaged in containers which are significantly difficult for small children to open. At the same time, however, it is also necessary that the closures can be opened by an older child or an adult.

Many prior art closures of this general type are made child-resistant by the cooperative action of a radially or vertically extending tab carried by the cap and a lug formed on the shoulder or lower portion of the neck of the container against which the tab impinges when the child seeks to open the container by unscrewing the cap. Many of this type of child-resistant closures ignore a difficulty arising from the normal manufacturing tolerances which are present in both the cap and the bottle neck, in the threads on both, in the thickness of the liner or other sealing means interiorly of the cap, etc. When the tolerances which are built in during the manufacture accumulate, the result may be that if the cap closes a container for liquids, when a small child endeavors to open the container, he may twist the cap in an opening direction a distance sufficient to create a leaking container.

The foregoing problems are particularly prevalent when the cap is a screw type cap and is so designed as to be placed upon the container by automatic capping machinery of the type used for capping ordinary screw caps. Preferably, a child-resistant closure should be of a type which can be handled by standard capping equipment so that many such closures are made of the screw type hopefully to enable automatic capping without the necessity for the person filling the containers to buy new capping equipment.

Particularly where the closures are of the type which comprise a disc-like liner interiorly of the cap, the compressibility of the liner enters into the question of whether or not the cap is turned on to the bottle neck to the proper distance both to seal the container and to place the child-resistant elements in child-resistant position. Because of the tolerances mentioned above, it therefore becomes necessary to so design the cap and the container neck to insure that when the cap is put on to the container neck, for example by an automatic torque-responsive capping machine, it will be turned on to the neck far enough to at least engage the child-resistant means. Usually, therefore, it is turned on to the neck a distance beyond the engagement of the child-resistant means in order to insure that the container is sealed.

The problem arises the second time after the container has once been opened by an adult or older child who has then restored the cap to reseal the container. If this person turns the cap on to the neck of the container only until the child-resistant elements reach their engaging position, the cap may not be turned on to the neck tightly enough to prevent the container from leaking. If the person turns the cap on to the container neck sufficiently far to insure that it is sealed against leakage, the child-resistant means are spaced from each other, and a small child may rotate the cap in an unscrewing direction until the child-resistant means engage and, in doing so, may relieve the downward sealing thrust of the threads sufficiently so that it will leak.

Even if the counter rotation of the cap does not allow the cap to elevate greatly relative to the container neck, because most liners are not perfectly resilient, and because the finish on the end of the container neck may not be perfect, the counter rotation by the child up to the point of engagement of the locking means may result in the cap being loose on the container neck.

As an illustration of the problem, in a more or less standard six pitch thread, for every ten degrees of rotation of the cap relative to the bottle there is approximately 0.005 inch change in elevation of the cap. If the tolerances normally encountered in the fabrication of such caps and bottles are cumulated, then a 120° retrograde rotation may be possible before the locking means abut, which will permit at least 0.055 inch elevation of the cap relative to the neck of the container.

It is also necessary to realize that when the cap is being threaded on to the container neck, the top surfaces of the cap threads bear against the under surfaces of the container neck threads. This thrusts the cap downwardly as it is rotated. Therefore, if the cap is rotated on to the container neck until it is tight and, particularly, when it must be rotated beyond the angular position at which the child-resistant means engage, the resulting problem is created.

With a normal screw type cap, when a person then endeavors to rotate the cap in a counter direction, i.e., seeking to unscrew the cap, the upper surfaces of the cap threads gradually disengage from the lower surfaces of the container neck threads and the cap is free to move up and down some fraction of an inch until continued rotation in the opening direction causes the engagement of the under surface of the cap threads with the upper surface of the container neck threads. This results from the fact that the vertical thickness of the threads on the interior of the cap cannnot be equal to the vertical space between the threads on the container neck. In order for the cap to be able to be screwed on to and off of the container, there must be clearance between the engaging surfaces of the two sets of threads and usually, to avoid unnecessary cap and bottle thread material, this clearance is a significant percentage of the space between the threads, say 35% or 0.06 inches.

It is in the interval between these two engagements that the cap is loose on the container neck and, with the six pitch thread, the cap may rotate 130°, 140°, or even 150° before the elevating engagement of the lower surfaces of the cap threads and the upper surfaces of the container neck threads takes place. Rotation even of a few degrees, say 10° or 15°, may be enough to result in a leaking container.

It is, therefore, the principal object of the instant invention to provide a screw type cap for the threaded neck of a container for liquids which is provided with a secondary cooperating means on the cap and container neck which hold the cap down in sealed position with sufficient force to prevent leakage from the container even when the cap has been rotated in an opening direction a distance such that it would otherwise have vertical play and a leaker might result.

It is a further object of the invention to provide a cap and a container neck equipped with cooperating cam means which exert downward thrust on the cap even when the cap has been rotated in an opening direction so as to disengage the upper surfaces of the cap threads and the lower surfaces of the container neck threads, thus holding the cap downwardly, holding the cap liner against the end of the container neck and maintaining the container in liquid sealed condition.

DESCRIPTION OF PREFERRED EMBODIMENT

While a cap and neck finish, in combination, which embody the invention, have great utility in insuring liquid-tight sealing of ordinary containers having threaded necks, the invention will be illustrated as it is applied to a liquid container also comprising child-resistant locking means.

Figure 1:
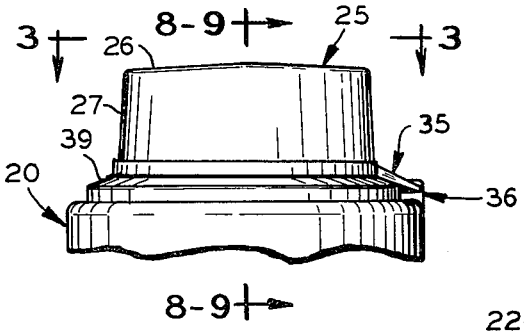
FIG. 1 is a fragmentary view in side elevation showing a cap and container embodying the invention with the cap in closed position on the container.
Figure 2:
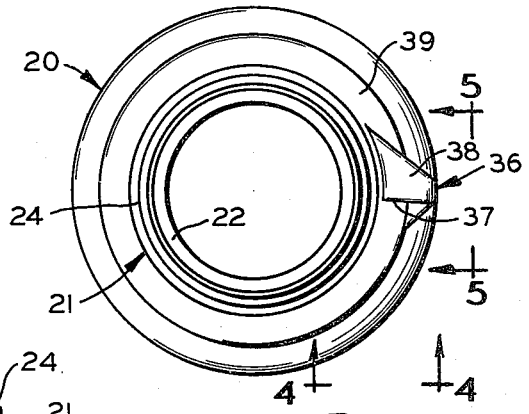
FIG. 2 is a top plan view of the container with the cap removed and showing the locking lug.
Figure 3:
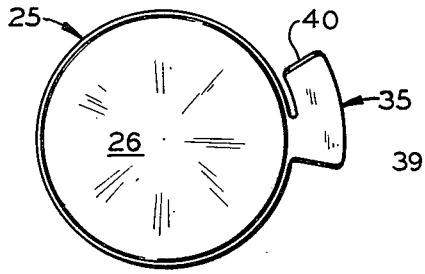
FIG. 3 is a top plan view of the cap showing the appearance of the locking tab.
Figure 4:
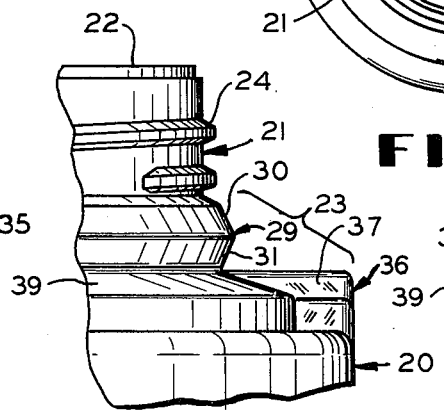
FIG. 4 is a fragmentary side view in elevation taken from the position indicated by the line 4—4 of FIG. 2 and shown on an enlarged scale.
Figure 5:
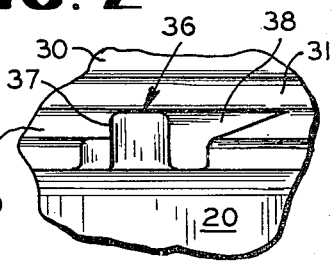
FIG. 5 is a fragmentary view in elevation taken from the position indicated by the line 5—5 and shown on the same scale as FIG. 4.
Figure 6:
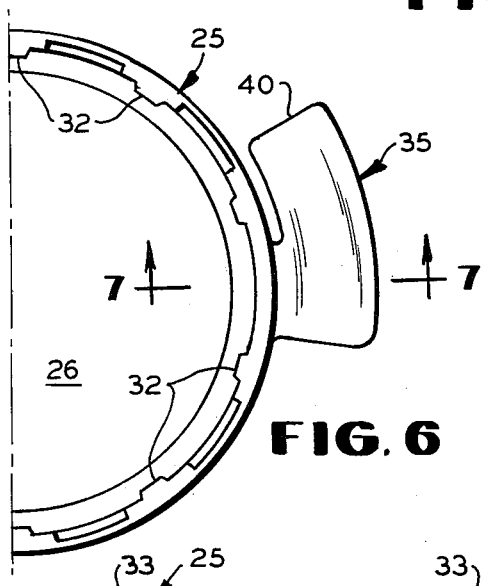
FIG. 6 is a bottom half-view of the cap shown on the same scale as FIGS. 4 and 5.

According to the invention, a container 20, fragmentarily illustrated in FIG. 1, has a threaded neck 21 with an open end defined by an annular lip 22. The neck 21 is connected to the container 20 by a particularly configured shoulder portion encompassed within the bracket 23 as shown in FIGS. 2 and 4. The neck 21 has an external thread 24.

A cap 25 has a disc-like top 26 and an annular skirt 27 depending from the top 26. The inner surface of the cap skirt 27 has threads 28 which mate with the threads 24 on the container neck 21. The shoulder portion 23 comprises the first one of a pair of cooperating surfaces, the first being formed as a part of a radially outwardly protruding annulus 29 (see particularly FIG. 4) which consists of an outwardly extending, upper frusto-conical surface 30 which meets at its larger diameter the larger diameter of a return frusto-conical lower surface 31. The radially larger portion of this first cooperating surface is, of course, the apex of the two inclined surfaces 30 and 31. The annulus 29 on the container neck 21 cooperates with what is illustrated as a series of circumferentially spaced, inwardly protruding cam lugs 32. The upper surfaces of the lugs 32 lie on and define portions of a second generally frusto-conical surface, the smaller diameter of such defined surface being less than the larger diameter of the annulus 29 on the neck 21. Although illustrated as separate spaced lugs 32, it will, of course, be appreciated that this second cooperating surface defined by the upper inwardly inclined surfaces of the lugs 32 may also be a continuous annular surface extending circumferentially around the inner side of the cap skirt 27, such surface extending the surfaces of the lugs 32 and functioning in the same fashion as the separate surfaces of the lugs 32 which define this functional second surface.

It should also be born in mind that in any screw type cap and neck, the vertical heights of the cap threads 28 must be less than the vertical spacing between the neck threads 24 in order that the cap can be screwed on to and off of the neck 21. In order to insure that the spacings are as just described, it is necessary in manufacture to dimension these parts so that even when their manufacturing tolerances cumulate in the wrong direction, the cap will not be bound up against rotation by its threads 28 being wedged between the neck threads 24. As a result of these requirements and manufacturing tolerances, when the cap 25 is being turned on to the neck 21 either by an automatic capping machine or by a person restoring the cap 25 on to the container 20, the upper surfaces of the cap threads 28 bear against the under surfaces of the neck threads 24 thus to exert downward thrust to carry the cap downwardly into sealing position on the neck 21 with sufficient tightness to squeeze a liner 33 or other sealing means into engagement with the open end of the container neck 21 or its lip 22.

In the illustrated embodiment, the liner 33 is a disc of compressible but resilient material so that when the cap 25 is turned downwardly on to the neck 21, the torque-responsive clutch of a capping machine will stop rotating the cap 25 relative to the container 20 at such point that sufficient force is exerted against the liner 33 and, in turn, against the lip 22 of the container neck 21 to insure a liquid-tight seal. Experience has shown that a force of from about 2 to 5 pounds is necessary to maintain a liquid seal in such an arrangement.

In the illustrated embodiment of the invention, the cap 25 also has at the upper end of its skirt 27 an inwardly protruding retaining lip 34 above which the disc-like sealing liner 33 is snapped prior to assembly of the cap 25 on the neck 21. The presence of the retaining lip 34 eliminates the necessity for adhering or otherwise attaching the liner 33 to the top 26 of the cap 25 and leaves it free to rotate relative to the cap 25 with an advantageous result later to be described.

Figure 9:
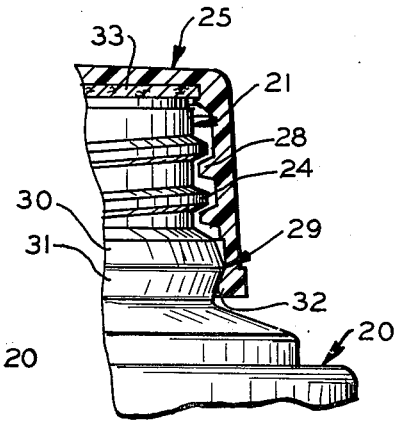
FIG. 9 is a view similar to FIG. 8 but illustrating how the secondary camming means holds the cap in its sealed position even after it has been rotated toward opening.

After the cap 25 has been turned down on to the neck 21 to a distance sufficient to insure liquid-tight sealing of the container, and the upper surfaces of the cap threads 28 are engaged with the under surfaces of the neck threads 24, and the container remains in liquid-tight sealing. Upon the first occasion of endeavoring to open the container, i.e., by turning the cap 25 in a retrograde or, usually, counter-clockwise direction, only a relatively few degrees of angular rotation are necessary to disengage the bearing surfaces just described and to create a situation as illustrated in FIG. 9 where these previously bearing surfaces of the mating threads are no longer in contact. In an ordinary cap, at this position, the cap is free to move up and down relative to the container neck a distance determined by the differences in the dimensions described above and/or by the tolerances in manufacture. This movement frequently is sufficient to allow the container to leak.

Figure 8:
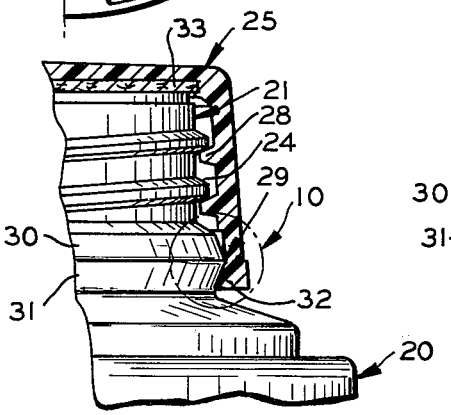
FIG. 8 is a fragmentary half-view in vertical section showing the cap and container with the cap threaded entirely on to the container in sealed position.
Figure 10:
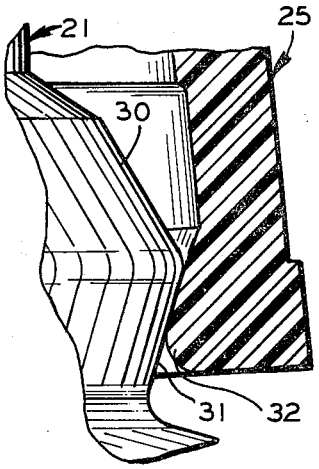
FIG. 10 is a greatly enlarged fragmentary view in section showing the detail of that portion of FIG. 8 included within the circle labeled 10.

In a threaded cap and neck finish according to the invention, however, the cap 25 is held in liquid sealing position even after being rotated through an angle of a substantial number of degrees in a retrograde or counter-clockwise direction by the cooperative action of the surface 31 on the container neck 21 and the surface defined by the upper faces of the lugs 32 on the cap skirt 27. As can best be seen by reference to FIGS. 8, 9 and 10, these two generally frusto-conical surfaces cooperate to retain the cap in its lower-most position even after the upper surfaces of the cap threads 28 have become separated from the lower surfaces of the neck threads 24 due to the retrograde rotation.

Of course, continued retrograde rotation of the cap 25 relative to the container neck 21 eventually engages the upper surface of the neck thread 24 with the lower surface of the cap thread 28, and as the cap continues to be rotated, this exerts upward thrust sufficient in force to pull the surface of the lugs 32 against the cooperating surface 31 on the neck 21, expanding the lower portions of the cap skirt 27 radially outwardly and pulling the cap 25 upwardly until the lesser diameter of the cooperating surface on the cap 25 passes the greater diameter of the cooperating surface on the container neck 21. Thereafter, the cap merely is unscrewed in conventional manner.

The cooperative actions of the mating threads of the threaded cap and container neck and the two cooperating substantially frusto-conical surfaces thus results in what might be called a combination screw and "snap on" cap. The "snap on" feature continues to exert sufficient retaining force on the cap 25 to hold it in liquid sealing condition even after the threads no longer can accomplish that result.

Figure 7:
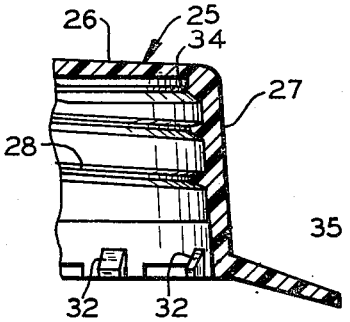
FIG. 7 is a fragmentary vertical sectional view taken along the line 7—7 of FIG. 6.

In addition, a cap as illustrated in the drawings and according to an improved embodiment comprises cooperating means by which that cap is rendered child-resistant. These child-resistant means comprise a radially outwardly extending tab generally indicated by the reference No. 35 and an abutment generally indicated by the reference No. 36 which is included within the special shoulder portion 23 of the container. The abutment 36 has a substantially vertical face 37 and a tapered rear surface 38. As can best be seen by comparing FIGS. 7 and 4, the tab 35 is angularly downwardly inclined relative to the horizontal and the shoulder portion 23 of the container 20 has a similar downwardly angled annular surface 39 which is frusto-conical in general configuration and tapered to substantially the same degree as the tab 35.

When the cap 25 is turned downwardly on to the neck 21 and approaches its liquid sealing position, the action of the cooperating camming surfaces 31 and 32 is effective to expand the lower portion of the skirt 27 outwardly so that they can pass each other and the under surface of the tab 35 approaches contact with the tapered surface 39 of the container shoulder 23. The angular positions of both the abutment 36 and the tab 35 on the shoulder portion 23 and cap skirt 27, respectively, are such that the cap will ordinarily reach liquid sealing position on the neck 21 after a trailing edge 40 on the tab 35 has passed the face 37 of the abutment 36. Again, because of tolerances in manufacture, it cannot be determined precisely that the cap will be in liquid sealing contact with the container immediately upon the passage of the trailing edge 40 of the tab 35 beyond the face 37 of the abutment 36. It only is necessary that the trailing edge 40 shall have passed the abutment face 37 when the cap reaches sealing position on the container neck 21. Therefore, in most instances the tab 35 will have been turned beyond its child-resistant engagement with the abutment face 37 by the torque-responsive chuck of an automatic capping machine or by a person restoring the cap, so that it will be spaced a considerable angular direction therefrom.

When a small child endeavors to open a container with harmful or dangerous contents, he may be able to turn the cap 25 in a retrograde direction until the locking tab 35 engages the abutment 36. It has been found that a small child, beneath the age of 6 or so, is incapable, however, of comprehending the necessity for lifting the tab 35 to a height sufficient to disengage it from the abutment 36 to allow continued retrograde movement.

Nevertheless, in an ordinary child-resistant cap having cooperating tab and lug, this retrograde movement which the child can accomplish often is sufficient to free the retaining surfaces of the cap and container threads enough so that the cap can move up and down a distance sufficient to result in a leaking container. By reason of the invention herein described, however, the action of the two cooperating surfaces, i.e., the surface 31 of the shoulder portion 23 and the surface defined by the upper faces of the cap lugs 32 exerts sufficient force downwardly on the cap 25 to maintain the liner 33 in liquid sealing contact with the lip 22 on the container neck 21.

The fact that in the best construction of a child-resistant cap embodying the invention the liner 33 is not sealed or adhered to the cap top 26, but is free to rotate relative thereto, as a further advantage. Often in the manufacture of containers, the annular surface of the neck lip 22 is not perfectly smooth. Irregularities in that surface are embossed into the under surface of the liner 33 when the cap 25 is turned downwardly on to the neck 21 in liquid sealing condition. Therefore, if the cap 25 is turned in a retrograde direction from its sealing position and backwardly to the child-resistant contact of the tab 35 and abutment 36, the liner 33 is retained tightly against the neck lip 22 by the cooperation of the two camming surfaces 31 and 32 so that the embossments in the lower surface of the liner 33 remain in position on the irregularities of the neck lip 22, again eliminating an otherwise likely pathway for leakage.

Having described my invention, I claim:

1. In combination, a screw-type cap having a top and a threaded container neck, container neck sealing means on the underside of said cap top, said cap and said neck having mating threads and cooperating opposed surfaces on said cap and said container that are adapted to be engaged when said cap is turned onto said neck into sealing position by the continued engagement of the downwardly effective surfaces of said threads and to continue to exert downward thrust on said cap for retaining said cap in sealing position even when said cap is rotated in a retrograde direction toward open position a sufficient degree to disengage the downwardly effective surfaces of said mating threads and an insufficient degree to disengage said opposed surfaces.

2. A cap and container neck according to claim 1 in which the cooperating opposed surfaces consist of an upwardly and outwardly directed annular surface on said container neck and a downwardly and inwardly directed surface on the skirt of said cap.

3. A cap and a container neck according to claim 1 and cooperating child-resistant locking means on said cap and said container neck which are engaged at least when said cap is turned on to said container neck to liquid sealing position.

4. A combination screw-type and snap-on cap and container neck, said cap having a disc-like top, an annular skirt, a liner on the under side of said top, and threads on the inner side of said skirt, said neck having external threads mating with the threads on said cap skirt, said cap and said container neck also having inter-engaging annular surfaces overlapping each other vertically which are forced into snap-on engagement when said cap is turned on to said neck to liquid sealing position, said surfaces being configured for exerting downward force on said cap for holding said cap in liquid sealing position even when said cap is turned in retrograde direction a degree sufficient to separate the downwardly effective surfaces of said mating theads.

5. A cap and container neck according to claim 4 in which the inter-engaging surfaces on said cap and neck are an outwardly and upwardly inclined annular surface on the exterior of said neck and a series of circumferentially spaced lugs on the interior of said cap having downwardly and inwardly inclined upper surfaces which snap beneath said annular surface when said cap approaches and reaches liquid sealing position on said neck.

6. A combination screw-type and snap-on cap and container neck according to claim 4 and disengageable child-resistance locking means on said cap and said container neck which are engaged at least when said cap is turned onto said neck into liquid sealing position.

7. In a cap and neck combination according to claim 4, a radially inwardly extending retainer for the liner on the inner side of the cap skirt and spaced beneath the under surface of the top of said cap a distance so as to retain said liner within said cap and rotatable to said cap.

8. A cap and neck combination according to claim 4 in which the inter-engaging surfaces overlap to such extent and are so configured as to provide for their being forced beyond each other as said cap is turned down on to said container, the skirt of said cap being resiliently expanded outwardly thereby and contracting for re-engaging said surfaces with the surface on said skirt beneath the surface on said neck.

9. Child-resistant closure means for a liquid container, said means consisting of, a. an inverted cup-shaped cap having,
   1. a generally circular top,
   2. a depending annular skirt having threads on its inner surface,
   3. a radially outwardly extending flexible tab on the lower end of said skirt,
   4. a circumferentially extending series of lugs on the inner side of said skirt beneath said threads, each of said lugs having an upper face that is inclined upwardly and radially outwardly and, b. a neck on said container having, 1. an external thread on said neck mating with the thread on said cap,
2. an abutment having a radially extending vertical face engageable by said tab after said cap is turned on to said neck to sealing position for preventing removal of said cap by retrograde rotation without disengagement of said tab and said abutment, and
3. an upwardly and outwardly inclined annular surface on said neck beneath said neck threads, said surface having a greater diameter larger than the smaller diameter of the upper surface of said lugs on said cap skirt, said annular surface on said neck and said lugs on said cap skirt being forced over each other by rotation of said cap on said neck to sealing position and being effective to resist elevation of said cap above sealing position where said cap is rotated in a retrograde direction an angular distance sufficient to disengage the upper surface of said cap threads with the lower surface of said neck threads but insufficient to engage the lower surface of said cap threads with the upper surface of said neck threads, whereby said cap is retaind in sealing position on said neck during retrograde rotation at least until said child-resistant tab is disengaged from said abutment.

10. In the combination of a cap having an internally threaded skirt and a container for liquid that has an externally threaded neck, the threads on said cap and said neck mating for retaining said cap on said container in liquid sealing relationship when said cap is turned on to said container with the undersurface of the thread on said neck bearing against the upper surface of the thread on said cap, the threads on said cap being of lesser dimensions than the spaces between the threads on said container neck, the improvement comprising cooperating generally frusto-conical surfaces on said cap skirt and on said container, the radially larger portion of the first one of said surfaces being greater than the radially smaller portion of the second of said surfaces, said second one of said surfaces having the radially smaller portion being radially outwardly deflected by said first one of said surfaces having the radially larger portion when said cap is turned down on to said container neck as said cap approaches liquid sealing position on said container neck, the positions of said cooperating surfaces on said cap and said container neck being such that said second one of said surfaces moves radially inwardly beneath said first one of said surfaces at least when said cap reaches an effective liquid sealing position on said container neck with said surfaces then being complementarily engaged, whereby, if said cap is turned in a retrograde direction a distance sufficient to disengage the bearing of the threads on said cap and said container neck, said surfaces continue to exert downward thrust on said cap for maintaining said cap in liquid sealing position on said container neck.

* * * * *